US005538569A

United States Patent [19]

Carter

[11] Patent Number: 5,538,569

[45] Date of Patent: Jul. 23, 1996

[54] PRIMER COMPOSITIONS CONTAINING DINITROBENZOFUROXAN COMPOUNDS

[75] Inventor: George B. Carter, Lichfield, England

[73] Assignee: Eley Limited, Birmingham, England

[21] Appl. No.: 519,173

[22] Filed: Aug. 25, 1995

[30] Foreign Application Priority Data

| | | | |
|---|---|---|---|
| Aug. 27, 1994 | [GB] | United Kingdom | 9417305 |
| Mar. 1, 1995 | [GB] | United Kingdom | 9504083 |

[51] Int. Cl.[6] ..... C06B 25/04

[52] U.S. Cl. ..... 149/105; 149/22; 149/67

[58] Field of Search ..... 149/17, 22, 67, 149/105

[56] References Cited

U.S. PATENT DOCUMENTS

| | | | |
|---|---|---|---|
| 1,495,350 | 5/1924 | Olin | 149/34 |
| 1,906,394 | 5/1933 | McNutt | 149/24 |
| 3,321,343 | 5/1967 | Staba | 149/24 |
| 3,423,259 | 1/1969 | Staba | 149/24 |
| 4,363,679 | 12/1982 | Hagel et al. | 149/37 |
| 4,581,082 | 4/1986 | Hagel et al. | 149/105 |
| 4,674,409 | 6/1987 | Lopata et al. | 102/471 |
| 5,167,736 | 12/1992 | Mei et al. | 149/22 |
| 5,353,707 | 10/1994 | Duguet | 102/290 |
| 5,417,160 | 5/1995 | Mei et al. | 102/289 |

FOREIGN PATENT DOCUMENTS

| | | |
|---|---|---|
| 696145 | 9/1967 | Belgium . |
| 031045 | 11/1980 | European Pat. Off. . |
| 129081 | 12/1984 | European Pat. Off. . |
| 1210604 | 10/1970 | United Kingdom . |

*Primary Examiner*—Charles T. Jordan
*Assistant Examiner*—J. R. Hardee
*Attorney, Agent, or Firm*—Cushman Darby & Cushman

[57] ABSTRACT

A non-toxic primer composition comprising a dinitrobenzofuroxan salt, oxidizer and a relatively high proportion of friction agent. A typical set of components are KDNBF with $KNO_3$ and ground glass.

13 Claims, No Drawings

PRIMER COMPOSITIONS CONTAINING DINITROBENZOFUROXAN COMPOUNDS

FIELD OF THE INVENTION

The present invention relates to priming compositions for use in percussion primers for ammunition and more particularly but not exclusively to primer compositions for rimfire ammunition.

BACKGROUND OF THE INVENTION

Previously such primer compositions have included two sensitive primary explosive constituents together with oxidizers, friction agents and fuel. The most commonly used main explosive constituent is lead styphnate which is always accompanied by a second primary explosive, tetrazene, which is essential to render the composition sufficiently sensitive to percussion and reproducible in its response. The most commonly used oxidizing agent is barium nitrate and antimony sulphide is often used as a fuel.

These primer compositions typically include elements such as lead, antimony and barium which are now considered to have high toxicity. Such elements produce a potential health hazard particularly within enclosed shooting ranges where they accumulate in the atmosphere and on surfaces. Thus, in recent years there has been a tendency towards so called non-toxic primer compositions.

These non-toxic priming compositions include diazodinitrophenol (DDNP) along with a sensitizer explosive such as tetrazene. Examples of such non-toxic priming compositions can be found in EP Patent Number 0440873 (Blount Inc), U.S. Pat. No. 4,674,409 (Olin Corporation) and others. Typically, the completeness of ignition for these compositions in particular has been unsatisfactory for rimfire ammunition. In the relatively unconfined conditions found in rimfire priming, complete and rapid explosion of the priming charge does not readily occur.

Furthermore, the necessity for a second primary explosive such as tetrazene which acts as a sensitizer within the primer composition leads to extra compounding and manufacturing requirements. In addition the inherent colour of DDNP is such that it is difficult to see within a brass ammunition casing.

It would be advantageous to establish a non-toxic primer composition that comprises a single explosive with associated friction agent, oxidizer and binder. Furthermore, if the composition has colour readily distinguishable from a brass casing there would be significant benefits. For the explosive to be non-toxic it should not contain toxic elements. For instance it could be a salt of a non-toxic element. Known non-toxic explosives formed of non-toxic elements are metal salts of dinitrobenzofuroxan including the potassium and the sodium salts (KDNBF and NaDNBF).

It is imperative that rimfire ammunition is suitably sensitive to enable consistent and reliable ignition. Normally primed cartridge cases are tested by dropping a known weight from a known height on to a striker pin abutting the rim of the case which is filled with priming composition. It will thus be appreciated that when the weight is dropped on the striker the rim is indented and the priming composition is exploded. The mean fire height is the height from which the weight must be dropped in order to explode 50% of the sample of primers. Acceptable fire heights vary for different types of ammunition and to a large extent it is more important that the priming composition is consistent in its response to percussion rather than being too sensitive.

The all-fire height is that from which the weight must be dropped to explode all primers in a sample (typically 50 primers). Typically, using a weight of 2 oz (57 g) and a chisel striker which represents that found in many target weapons, an all-fire height of between 9–11" (229–279 mm) is acceptable for rimfire target ammunition.

The primer composition must explode rapidly and completely when the rim of the cartridge is suitably struck. As shown in EP 0529230 (Blount Inc) and U.S. Pat. No. 4,674,409 (Olin Corporation) it is possible to provide a packing above the primer composition in the rim of such ammunition in order to at least initially confine the primer composition to ensure complete combustion and thus enhance the effect of its ignition of the propellant. Such confinement requires the introduction into the cartridge of combustible bodies such as a layer of compressed propellant which may interfere with the consistency of the propelling impulse given to the bullet, rendering such ammunition unsuitable for competition shooting.

Unfortunately, previous studies as exemplified by EP 0580486 (NCS Pyrotechnic et Technologies) have indicated that to be effective a combination of two primary explosives is required when using KDNBF. Tetrazene must be used as a sensitizer. Thus, single explosive primer compositions have previously been found to be either too inconsistent or too insensitive.

Additional sensitizing explosives add to manufacturing complexity and cost. Furthermore, the sensitizing explosive tetrazene is unstable and may deteriorate with time and so affect the performance of the primer.

Typically, primer compositions are mixed as a paste with a little water. This paste is then spread and packed into holes provided in a priming plate. The cylinder of primer composition packed into each hole represents the amount of primer for each casing or percussion cap.

The paste is ejected from the priming plate as a pellet into each case or cap by a suitable rod or peg. Thus, at the bottom of each casing there will be a cylinder shaped volume of primer composition paste. With rimfire ammunition it is required to pack this primer composition uniformly into the rim at the base of the case. A common technique is to spin a tool inserted within the casing such that the primer is packed into the rim. The primer is effectively squeezed or pumped into the rim.

Once the primer composition is located in the rim then each casing is either force-dried or naturally dried to drive off residual water within the composition leaving a dry fillet of sensitive composition around the base of the case. If required a small proportion of a water-soluble adhesive or binder may be included in the mix to ensure the integrity of the fillet. In the table, dry proportions are quoted for comparison between compositions.

SUMMARY OF THE INVENTION

In accordance with one aspect of the present invention, there is provided a non-toxic primer composition comprising, by dry weight percentage, a dinitrobenzofuroxan salt, a dinitrophenylazide salt or a diazinate (as hereinafter defined) in the range 25–55%, an oxidising agent with non-toxic constituents in the range 10–40%, and a friction agent in the range 10–40%.

In accordance with a further aspect of the present invention, there is provided a non-toxic primer composition comprising, by dry weight percentage, a dinitrobenzofuroxan salt or a diazinate (as hereinafter defined) in the range 40–45% together with an oxidising agent in the range of 17–35% and boron and/or glass particles in the range 15–40%. When boron particles/crystals are used, it may be preferable to incorporate them in quantities in the range 20–35% or 30–35% depending on the coarseness of the boron particles.

Diazinate, in the context of this specification, means a salt of mono- or di-nitrodihydroxydiazo-benzene, for example, strontium or potassium di-nitrodihydroxydiazo-benzene.

The oxidizing agent may be, for example, potassium nitrate, manganese dioxide or zinc peroxide.

When boron particles are employed as a frictionator, it is desirable to use particles of a coarse mesh, as they are more effective in providing increased sensitivity of the priming compound. Typical ranges for such boron particle sizes are 100–150 microns or 75–100 microns or a combination of such meshes.

Boron particles may comprise 15–40% of the composition. A non-toxic primer fuel may be incorporated, constituting 2–20% of dry percentage weight. A binder may comprise 0.5–5% of weight.

Preferably, the friction agent is ground glass or boron particles.

Preferably, the fuel when used is aluminium powder, calcium silicide, sulphur, sieved ball propellant powder or similar material.

One desired composition of the primer is 45% dinitrobenzofuroxan salt, 15% oxidizing agent, 35% friction agent and the remainder fuel and binder. Alternatively, 40% KDNBF, 25% oxidizer, 35% friction agent may be used.

BRIEF DESCRIPTION OF THE DRAWINGS

Embodiments of the present invention will now be described by way of example only with reference to the accompanying table 1 depicting various primer compositions and results.

In the column headings of table 1, percussion sensitivity is indicated by the mean fire height H, standard deviation S and the number of cases misfiring in 50 tested at a drop height of 9 inches (229 mm), all tests being conducted in a steel test housing fitted with a chisel striker and using a 2 oz (57 g) weight. It will be appreciated that a small number of misfires at 9 inches (229 mm) indicates good sensitivity.

Considering table 1, composition A illustrates the potassium salt of dinitrobenzofuroxan mixed with potassium nitrate as an oxidizer, tetrazene as a second explosive or sensitizer and glass powder as a friction agent. The mean fire height (H) and the standard deviation(S) in fire height are both acceptable. This composition A is consistent with EP 0580486 (NCS) in that prior teaching is that a second or sensitizer explosive tetrazene is required to ensure consistent fire height performance for dinitrobenzofuroxan primer compositions.

Compositions B and C are known lead styphnate primer compositions. with composition B, a common "spin priming" composition for rimfire ammunition. The styphnate is mixed with barium nitrate, tetrazene, colouring dye and lead hypophosphite. The results are acceptable with regard to fire height (H) and better than composition A in respect of consistency as shown by standard deviation (S) in the fire heights. Similarly, composition C manufactured in accordance with the so-called ELEYPRIME process of Eley Limited (UK Patent Nos 1569874 and 2075OOOB) and, in this example, used as a spin-priming mix produces good fire heights and consistency of fire height performance. However, these compositions still require tetrazene as a sensitizer and thus have a complicated two explosive composition. The colouring dye is added to ensure the primer can be seen for visual inspection in the casing.

DESCRIPTION OF THE PREFERRED EMBODIMENTS

Compositions D to W are single explosive primers in accordance with the present invention.

Composition D comprises 40% potassium dinitrobenzofuroxan (KNDBF) with 25% potassium nitrate as an oxidizer and 35% ground glass as a friction agent. The mean fire height (H) is good and consistency as shown by standard deviation (S) in fire height is excellent. Ballistic performance in some circumstances may be weak possibly due to an effective reduction in explosive content from 45% (40% KDNBF, 5% tetrazene) in composition A to 40% KDNBF only.

Composition E is similar to composition D in regard to explosive content but 5% aluminium powder as a fuel has been added along with 2% dextrin as a binder at the expense of oxidizer content. Mean fire height (H) and standard deviation (S) remain good. However, there may be similar problems to composition D in respect of performance due to explosive content.

Composition F has 45% KDNBF with similar amounts of $KNO_3$ oxidizer and glass friction agent to composition E but no fuel. The average mean height (H) is acceptable but consistency as shown by standard deviation (S) is reduced; however this was probably due to mis-packing in the rim. Furthermore, it was found that there was one mis-fire in a sample of fifty casings tested at a 9" (229 mm) drop height but this is acceptable within the 9–11" (229–279 mm) all fire criterion.

Composition G has the same explosive KDNBF content but reduced oxidizer $KNO_3$ to accommodate 5% sulphur as a fuel. Mean fire height (H) is slightly improved with respect to composition F and consistency is much better. However, there were two mis-fires in a sample batch of 50 test casings at a drop height of 9" (229 mm) but again this is acceptable within the desired all fire criterion. During the priming plate filling process composition G was found to have a tendency to crumble or fracture possibly due to the water repellent effect of sulphur. However, there is no obvious benefit or detrimental effect of adding sulphur in comparison with aluminium powder.

Composition H is similar to composition E in that aluminium powder is used as the fuel except that the explosive KDNBF content has been increased by 5%. The results give a slightly larger mean fire height (H) but better consistency. However, ballistic performance was very good and comparable with current high grade rimfire ammunition.

Cases (.22LR) primed with composition H were loaded with 72 mg single-base propellent, bulleted, cannelured and lubricated in the usual way to produce cal .22 standard velocity ammunition. The recorded pressures and muzzle velocities averaged 14,740 psi (standard deviation 490) and 1067 feet per second (standard deviation 7.1). The diameters of 10-shot groups at 50 metres range were 19.1, 11.3, 16.2, 13.1 and 12.4 mm. The diameters of the groups at 100 yds were 36.1, 22.2, 28.7, 32.7 and 27.9 mm.

Composition I has a consistent high explosive KDNBF content but the proportions of oxidizer $KNO_3$ and ground glass were reversed relative to composition H. The results are poor both in terms of mean fire height (H) and consistency. Thus, the friction agent (glass) is important to provide a practical primer from dinitrobenzofuroxan salts. A high glass content is important with single explosive primers made from DNBF salts.

Composition J as compared to earlier compositions has roughly equal proportions of oxidizer $KNO_3$ and friction agent ground glass. Composition J is roughly intermediate in content and gives roughly intermediate results. However, with the sample tested there was a surprisingly low number of mis-fires in a 50 casing test at 9" (229 mm) drop height Composition K has an increased KDNBF content to 50% whilst the oxidizer $KNO_3$ content is reduced to 10%. Fuel (aluminium powder), glass and binder contents are similar to earlier compositions. The mean fire height (H) and standard deviation (S) are acceptable but it would appear that there is a reduction in performance as compared to an enhancement expected with increased explosive content from earlier primer compositions. Again this is most likely due to ingredient distribution.

Composition L has 45% explosive KDNBF with only 10% oxidizer ($KNO_3$) but an increased content 40% of friction agent (glass). The mean fire height result is good but consistency is excellent. Furthermore, no mis-fires were found with a 50 casing test at a 9" (229 mm) drop height.

In composition M, aluminium powder is replaced by 5% sieved ball propellant powder as a fuel/gas producer. This in terms of average fire height (H) and standard deviation (S) had no detrimental effect. Similarly, in composition N where the fuel used is calcium silicide the results are consistent with earlier performance.

Composition P is similar to composition F except that instead of potassium nitrate, the oxidizer is finely divided manganese dioxide. The results for mean fire height (H) and consistency are reasonable. Similarly, composition Q has zinc peroxide as the oxidizer and the results are good. However, both compositions P and Q were found to have quite weak reports and so may not have sufficient brisance for rimfire bulleted ammunition although they may be suitable for use in blanks.

With composition R crystalline boron proves to be an extremely effective frictionator and gives phenomenal sensitivity. It may prove to be too sensitive for commercial use.

The results of composition S which incorporates crystalline boron with a grit size of 100–150 microns confirm the effectiveness of crystalline boron.

The results of composition T which incorporates crystalline boron with a grit size of 75–100 microns indicate that the use of smaller grit size crystalline boron reduces sensitivity.

We have also found that a separate primer fuel is not always necessary. In this instance boron behaves to some degree as a fuel as well as a friction agent, but it is not always necessary that a primer fuel as such be present in the primer composition.

Composition U results show that manganese dioxide of coarser grit size (100–150 microns) works satisfactorily in a rim-fire priming application, apparently combining the function of oxidising agent with some frictionating effect.

Composition V is a simple mixture with no binder or separate fuel and provided very good sensitivity and good ballistics.

Composition W is included as an example of a non-lead containing primer which retains barium in the composition. The results were satisfactory.

As an alternative to using KDNBF or a dinitrobenzofuroxan salt, a dinitrophenylazide salt or a diazinate could be used as a primary explosive.

In Table 1, in the column marked "other", the superscripts identify additions or changes as follows:

1=Lead hypohosphite
2=Sieved Ball Powder
3=Calcium Silicide
4=Manganese dioxide
5=Zinc peroxide
6=Boron
7=Sulphur It is clear from the results depicted in Table 1 that it is friction agent content that is the principal determining factor in performance. The oxidizer can be changed without too much detrimental effect or improvement to the results whilst friction agent content does affect performance. It may be presumed that many gritty materials could be used including sands, minerals, carbides, calcium silicide, ground coke and other abrasive grits along with ground glass as demonstrated. Table 1 indicates several results for mis-fires at a 9" (229 mm) drop height. As indicated previously it is generally accepted that there must be an all fire height of between 9" (229 mm) and 11" (279 mm). Thus, if there are less than two mis-fires at 9" (229 mm) then it is safe to assume there will be none or only rare mis-fires at 11" (279 mm), an acceptable all-fire height for general target ammunition. It is clear from the mis-fire results that compositions I and J ie those with lower friction agent (glass) content, have performed less well. Such results add weight to the necessity of high friction agent content in providing a primer composition in accordance with the present invention Some current lead styphnate priming compositions employed in top quality .22 RF target ammunition use in the order of 36 mg of primer in each casing with 25% glass. This is due to use of a ram type packing technique rather than spin priming. Thus, the glass content is 9 mg whereas a single explosive primer composition in accordance with the present invention would have about 18 mg per casing with 35% or 6 mg glass.

Typically, the KDNBF may have a particle size of about 10 microns, the oxidizing agent may have a size of about 100–150 microns and the glass 75–150 microns.

Acceptable composition ranges for potential primer compositions are (% dry weight):

| | | |
|---|---|---|
| KDNBF | 25–55% | preferably 45% |
| oxidizers | 10–40% | preferably 15% |
| Friction Agent | 10–45% | preferably 35% |
| Fuel | 3–15% | preferably 5% |
| Binder | 0.2–2% | |

The preferred DNBF salt is potassium dinitrobenzofuroxan with potassium nitrate as the oxidizer. However, the barium salt may be used, which provides a lead-free primer although barium has some degree of toxicity.

It will be understood that it may be possible to produce dinitrobenzofuroxan in-situ within the casing, thus reducing the explosion hazard when priming the casing.

TABLE 1

| COMP NO. | KDN-BF | LEAD STYPHNATE | Ba $(NO_3)_2$ | $KNO_3$ | TETRAZENE | GLASS POWDER | Al POWDER | DEXTRIN BINDER | DYE | OTHER | CHARGE WT (mg) | H (in) | S (in) | MISFIRES 9" |
|---|---|---|---|---|---|---|---|---|---|---|---|---|---|---|
| | INGREDIENTS (% DRY) | | | | | | | | | | | | | |
| A | 40 | | | 20 | 5 | 35 | | | | | 32 | 5.7 | 1.22 | |
| B | | 44 | 21 | | 3 | 25 | | | 0.3 | 7.6[1] | 18 | 6.6 | 1.00 | |
| C | | 47.6 | 22.7 | | 4.6 | 25 | | | 0.1 | | 20 | 6.21 | 1.00 | |
| D | 40 | | | 25 | | 35 | | | | | 16 | 5.86 | 0.55 | 0 |
| E | 40 | | | 20 | | 33 | 5 | 2 | | | 16 | 6.0 | 1.26 | 0 |
| F | 45 | | | 20 | | 34 | | 1 | | | 15.9 | 5.88 | 1.68 | 1 |
| G | 45 | | | 15 | | 34 | | 1 | | 5[7] | 16 | 5.78 | 1.02 | 2 |
| H | 45 | | | 15 | | 34 | 5 | 1 | | | 18 | 6.10 | 1.09 | |
| I | 45 | | | 34 | | 15 | 5 | 1 | | | 18 | 8.07 | 1.71 | 22 |
| J | 45 | | | 24 | | 25 | 5 | 1 | | | 18 | 6.79 | 1.73 | 3 |
| K | 50 | | | 10 | | 34 | 5 | 1 | | | 18 | 6.58 | 1.25 | 1 |
| L | 45 | | | 10 | | 40 | 4 | 1 | | | 19.6 | 6.22 | 0.76 | 0 |
| M | 45 | | | 15 | | 34 | | 1 | | 5[2] | 18.75 | 6.10 | 1.09 | 2 |
| N | 45 | | | 15 | | 34 | | 1 | | 5[3] | 19.5 | 6.22 | 1.02 | 0 |
| P | 45 | | | | | 34 | | 1 | | 20[4] | 18.25 | 7.06 | 1.35 | |
| Q | 40 | | | | | 34 | | 1 | | 25[5] | 19.5 | 5.94 | 0.58 | 2 |
| R | 40 | | | 25 | | | | | | 35[6] | 18.4 | 3.46 | 1.33 | |
| S | 45 | | | 35 | | | | | | 20[6] | 18.1 | 4.73 | 2.50 | |
| T | 45 | | | 35 | | | | | | 20[6] | 18.7 | 6.06 | 2.39 | |
| U | 45 | | | | | 34 | | 1 | | 20[4] | 20.6 | 5.26 | 1.64 | |
| V | 45 | | | 20 | | 35 | | | | | 19.3 | 5.66 | 1.04 | |
| W | 40 | | 25 | | | 35 | | | | | 19.6 | 4.79 | 1.19 | |

I claim:

1. A primer composition comprising, by dry weight percentage, a dinitrobenzofuroxan salt, as the only primary explosive, in the range 25 to less than 50%, an oxidising agent with non-toxic constituents in the range 10–40%, and a friction agent in the range 10–40%, said composition being free from tetrazene and any component which emits fumes or other combustion products containing toxic metals.

2. A primer composition as claimed in claim 1 comprising, by dry weight percentage, a dinitrobenzofuroxan salt in the range 40–45% together with an oxidising agent in the range of 17–35% and, as the friction agent, glass particles in the range 15–40%.

3. A primer composition as claimed in claim 1 in which boron particles are included as a friction agent in the range 20–35%.

4. A primer composition as claimed in any preceding claim in which the oxidising agent is potassium nitrate.

5. A primer composition as claimed in claim 3 in which the boron particle size is between 75 and 100 microns.

6. A primer composition as claimed in claim 1 in which a non-toxic primer fuel is incorporated and constitutes 2–20% of dry weight of the primer composition.

7. A primer composition as claimed in claim 1 in which a binder is incorporated and comprises 0.5–5% by weight of the primer.

8. A primer composition for rimfire ammunition as claimed in claim 1 comprising 45% dinitrobenzofuroxan salt, 15% oxidising agent, 35% friction agent and the remainder fuel and binder.

9. A primer composition as claimed in claim 1 comprising 40–45% potassium dinitrobenzofuroxan, 25% oxidiser and 35% friction agent.

10. A primer composition according to claim 3 in which boron particles are included as a friction agent in the range of 30–35%.

11. A primer composition comprising, by dry weight percentage, a dinitrobenzofuroxan salt as the only primary explosive, in the range of 25–55%, potassium nitrate as oxidising agent in the range 10–40%, from 0 to 20% aluminum powder as fuel and a friction agent in the range of 10–40%, said composition being free from tetrazene and any component which emits fumes or other combustion products containing toxic metals.

12. A primer composition according to claim 11 consisting of 40–50% dinitrobenzofuroxan salt, 15–35% potassium nitrate, 15–35% glass powder, 0–5% aluminum powder and 0–2% binder.

13. A primer composition comprising, by dry weight percentage, a dinitrobenzofuroxan salt as the only primary explosive, in the range of 25–55%, potassium nitrate, manganese dioxide or zinc peroxide as oxidising agent in the range 10–40%, from 0 to 20% aluminum powder as fuel and a friction agent in the range of 10–40%, said composition being free from tetrazene and any component which emits fumes or other combustion products containing toxic metals.

* * * * *